US006913368B2

(12) United States Patent
Leu

(10) Patent No.: US 6,913,368 B2
(45) Date of Patent: Jul. 5, 2005

(54) TEN-IN-ONE POCKET STATIONERY UNIT

(75) Inventor: Ching-Biau Leu, Taipei (TW)

(73) Assignee: Neway International Lifetech Corporation, (TW)

( * ) Notice: Subject to any disclaimer, the term of this patent is extended or adjusted under 35 U.S.C. 154(b) by 57 days.

(21) Appl. No.: 10/658,369

(22) Filed: Sep. 10, 2003

(65) Prior Publication Data

US 2005/0052861 A1 Mar. 10, 2005

(51) Int. Cl.[7] ..... B25B 23/18

(52) U.S. Cl. ..... 362/119; 362/253

(58) Field of Search ..... 362/119, 120, 253; 7/118, 135, 150, 160, 162–165

(56) References Cited

U.S. PATENT DOCUMENTS 4,783,867 A * 11/1988 Tsao ..... 7/160

* cited by examiner

*Primary Examiner*—Sandra O'Shea
*Assistant Examiner*—Mark Tsidulko
(74) *Attorney, Agent, or Firm*—Dennison, Schultz, Dougherty & MacDonald

(57) ABSTRACT

The present invention relates to a ten-in-one pocket stationery unit that is especially suitable for students, office workers and frequent travelers. The pocket stationery unit adopting precision designs and crafty room layout is equipped with ten functions in a single unit, including: a tape measure, a carton opener, a stapler, a hole puncher, scissors, a pencil sharpener, a nail file, an LED lighting, a minus-type and a Philips-type screw driver, a housing defined by a top cover, a bottom seat, an upper partition and a lower partition, to allow easy carriage and to provide convenience.

8 Claims, 5 Drawing Sheets

TEN-IN-ONE POCKET STATIONERY UNIT

FILED OF THE INVENTION

The present invention relates to a stationery unit, especially to a ten-in-one pocket stationery unit that can be easily carried and gathers and unites commonly used stationeries into one uni5.

BACKGROUND OF THE INVENTION

For students or office workers, their desks are always full of various stationeries. For frequent travelers, the various stationeries cause even more inconvenience in carriage. Hence, U.S. Pat. No. 4,783,867 discloses a multi-functional stationery unit that is equipped with a craft knife, a tape ruler, a nail extractor, a pencil sharpener, a carton opener, a stapler, scissors and a hole puncher in a housing defined by a front cover, a front leading seat, a rear cover and a rear leading seat. The multi-functional stationery unit gathers some commonly used stationeries into a single unit for convenience of students, office workers and frequent travelers.

SUMMARY OF THE INVENTION

Based on same inventive ideas as U.S. Pat. No. 4,783,867, the present invention combines multiple stationeries by adopting precision designs and crafty room layout to feature the stationery unit with ten commonly used stationeries, including a tape measure, a carton opener, a stapler, a hole puncher, scissors, a pencil sharpener, a nail file, an LED lighting and minus-type and Philips-type screw drivers, such that the stationery unit can be easily carried.

The main objective of the present invention is to provide a ten-in-one pocket stationery unit, by adopting precision designs and crafty room layout. The stationery unit is equipped with ten commonly used stationeries, including: a tape measure, a carton opener, a stapler, a hole puncher, scissors, pencil sharpener, a nail file, an LED lighting and minus-type and Philips-type screw drivers in a housing defined by a top cover, a bottom seat, an upper partition, a lower partition, such that the stationery unit can be easily carried by students, office workers and travelers.

BRIEF DESCRIPTION OF THE DRAWINGS

The present invention will now be described in further detail hereinafter, with reference to the accompanying drawings.

DESCRIPTION OF THE PREFERRED EMBODIMENT

Figure 1:
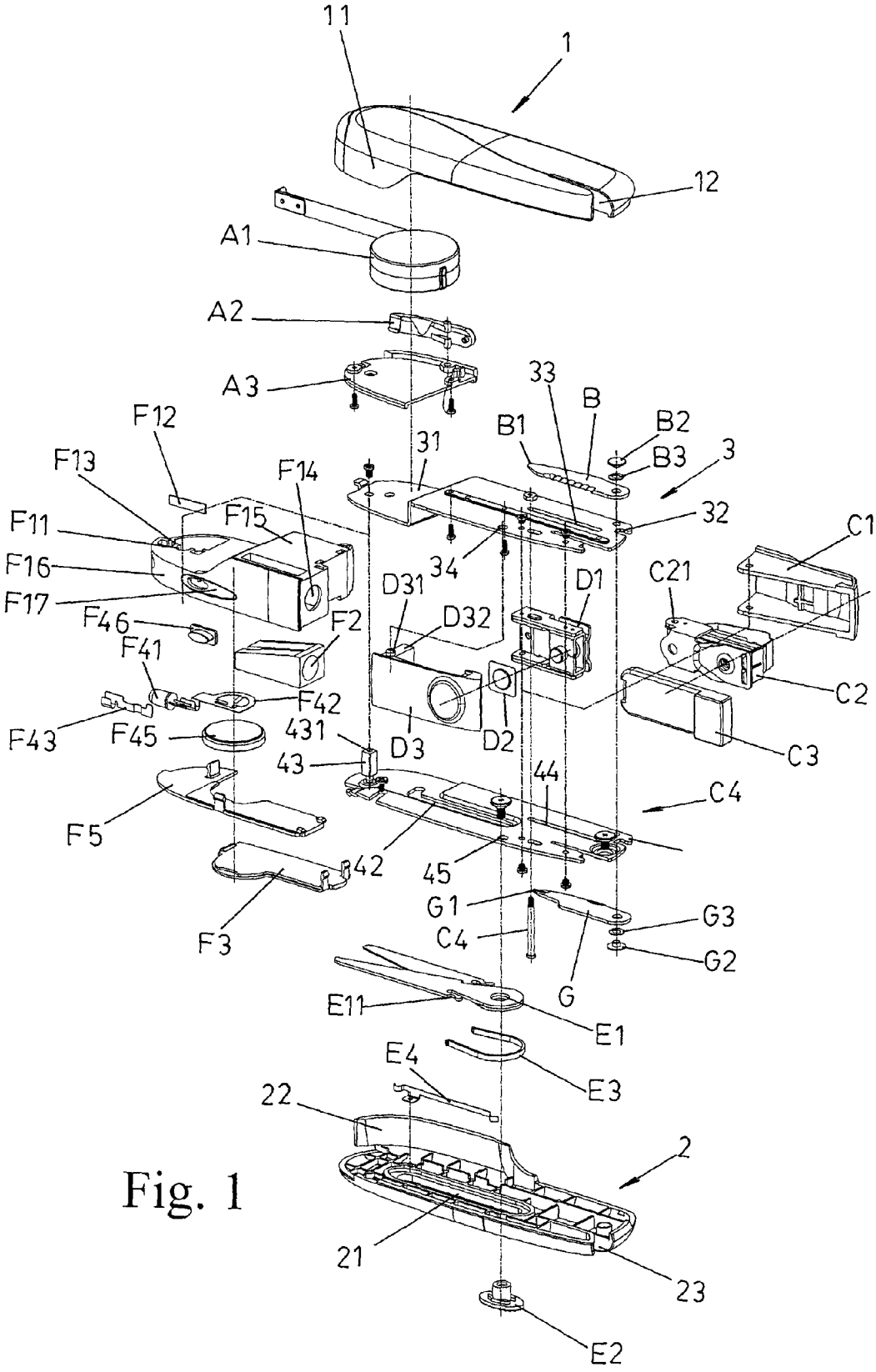
FIG. 1 is an exploded perspective of the present invention.

Please refer to FIG. 1, the exploded perspective of the present invention. The present invention is equipped with ten commonly used stationeries, including: a tape measure A, a carton opener B, a stapler C, hole puncher D, scissors E, a pencil sharpener F, a nail file G, an LED lighting H, a minus-type screw driver 1 and a Philips-type screw driver J in a housing defined by a top cover 1, a bottom seat 2, an upper partition 3, a lower partition 4, such that the stationery unit can be easily carried.

Figure 2:
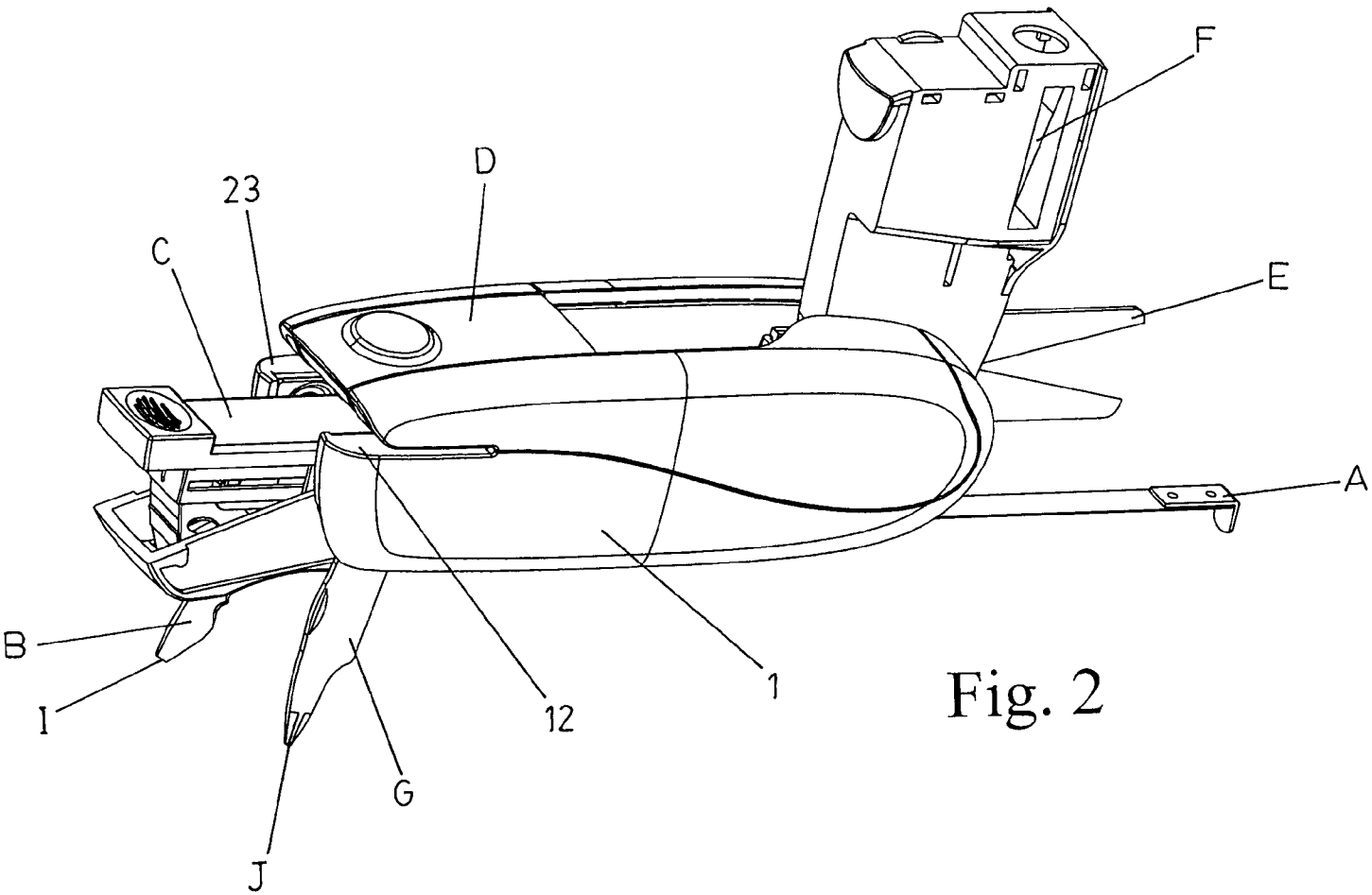
FIG. 2 illustrates an embodiment of the present invention.
Figure 3:
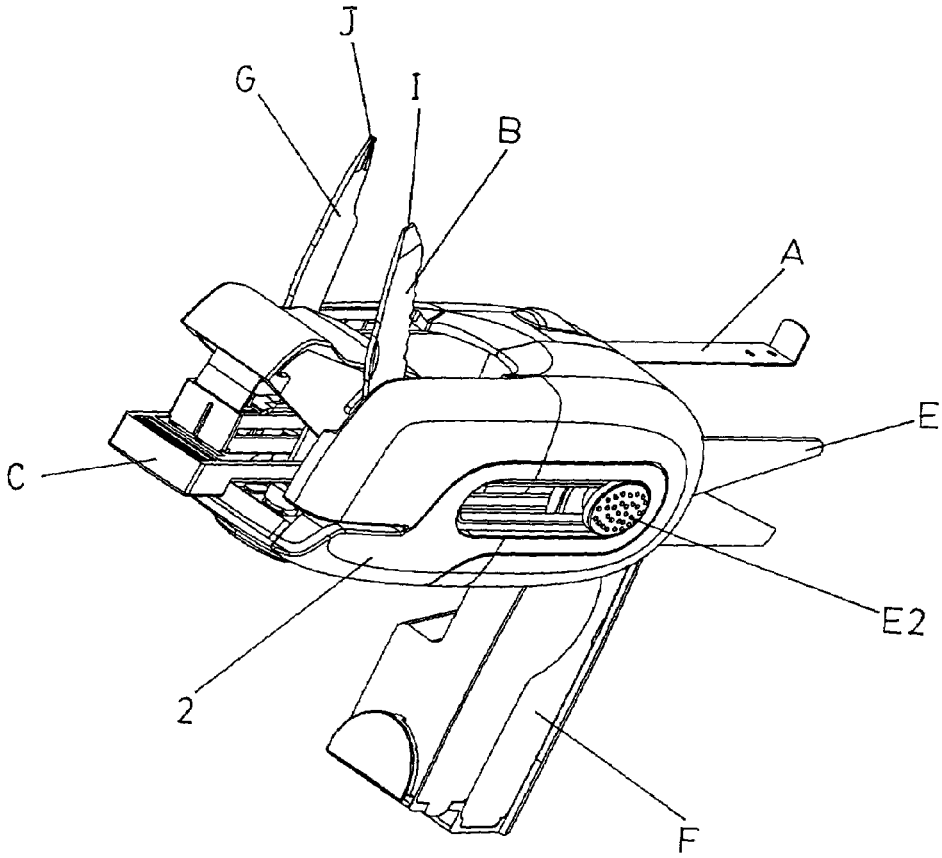
FIG. 3 illustrates an embodiment of the present invention taken from another view.

Please refer to FIG. 2 and FIG. 3 that illustrate a preferred embodiment of the present invention. The tape measure A is received between a left side of the upper cover 1 and the upper partition 3. A measuring tape A1 and a retaining presser A2 are fixed to a base A3, which is fixed in a cupped area 31 retained at a left side of the upper partition 3, so as to allow the measuring tape A1 to be pulled in a lateral direction and controlled by the retaining presser A2 to prevent from retraction.

The carton opener B is retained at opposite sides of the tape measure A and is fixed to an upper right corner 32 of the upper partition 3 by a rivet B2. The carton opener B can rotate outwards around the rivet from its sitting location to be used for opening carton. To allow smooth outward rotating of the carton opener B, a sliding spacer B3 is disposed between the rivet B2 and the carton opener B to reduce friction produced by rotation. In addition, the head of carton opener B is formed with a flat B1, so the carton opener B can also serve as a minus-type screwdriver.

Corresponding to the position of the carton opener B, the nail file G is fixed to an upper right corner 41 of the lower partition 4 by a rivet G2. The nail file G can rotate outwards around the rivet from its sitting location and to be used for filing nail. To allow smooth outward rotation of the nail file G, a sliding spacer G3 is disposed between the rivet G2 and the carton opener G to reduce fraction produced by rotation. In addition, the head of the nail file G is formed with a tine taper G1, so that the carton opener B can also serve as a Philips-type screwdriver J.

The scissors E are retained on the same side as the tape measure. The scissors are fixed by an upper screw passing through an end fixing hole E1 provided to the scissors E and capped with a button E2 protruding from a long hole groove provided to the bottom seat 2, so that the scissors are retained between an L-shaped groove 42 of the lower partition and the long hole groove of the bottom seat. When pushing the button E2 of the scissors outward from its sitting location to a critical point of a long side and a short side of the long hole groove 21 and the L-shaped groove 42 of the bottom seat, a U-shaped spring E3 that is disposed on a bottom of the scissors and hooked to cupped grooves E11 on opposite sides of the scissors will enable the initially closed scissors to open by means of the recovery force of the spring E3. At the same time, this action forces the top cover 1 to offset from the bottom seat 2 by a small angle. As such, one can use his thumb and index finger to press the corresponding pressers 11, 22 of the top cover 1 and the bottom seat 2, respectively, to allow operation of the scissors within the area of the short side of the L-shaped groove. To allow smooth outward pushing of the scissors E, a sliding rail E4 is disposed between the U-shaped spring E3 and the long hole groove 21 of the bottom seat to prevent the U-shaped spring E3 from touching the long groove 21 of the bottom seat during movement due to point contact between the spring and the sliding rail E4 to reduce friction produced by movement.

Figure 4:
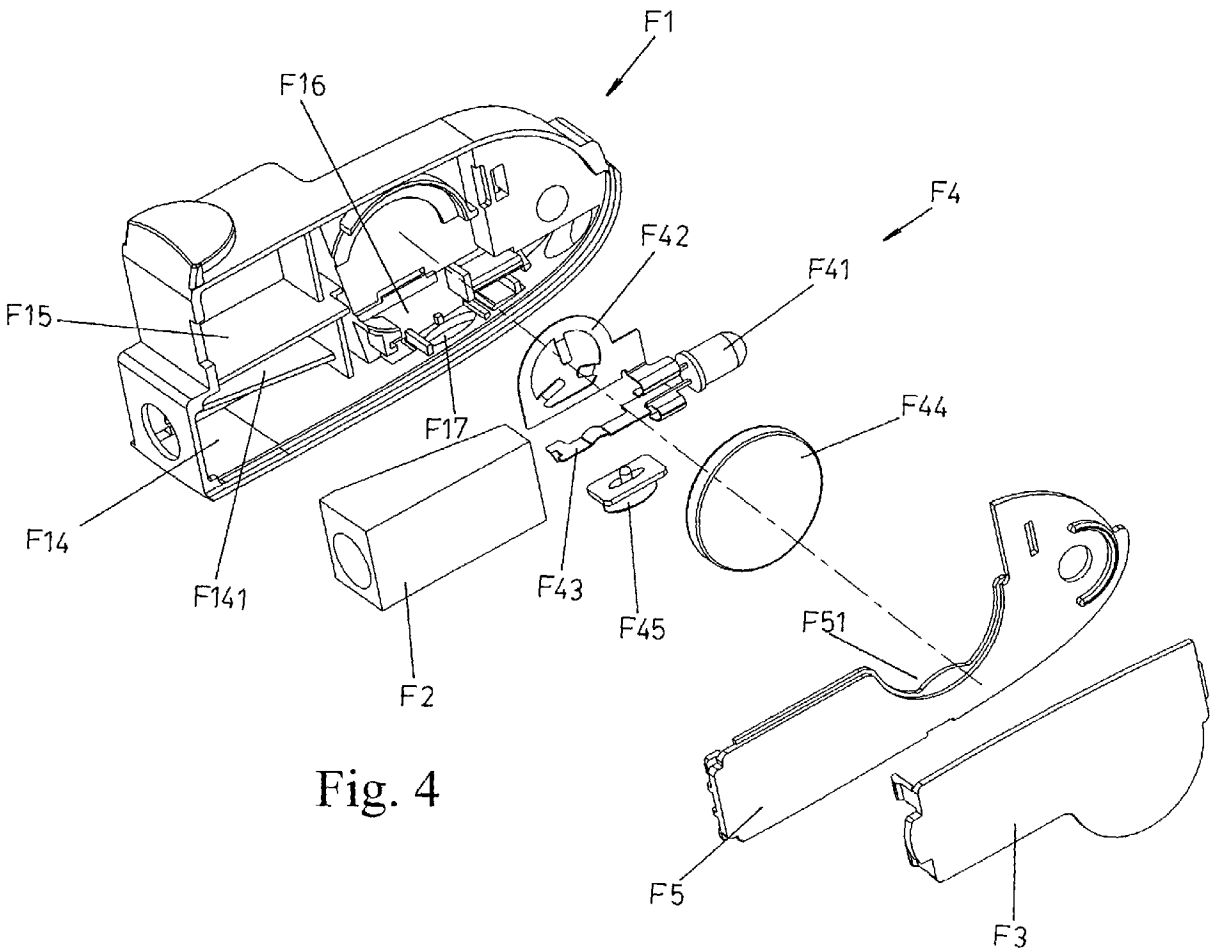
FIG. 4 is exploded perspective of a pencil sharpener used in the present invention, taken from another view.

Please refer to FIG. 4, the pencil sharpener F is disposed between the upper partition 3 and the lower partition 4. The pencil sharpener F includes a case F1 that is fixed between the upper partition 3 and the lower partition 4, in such a manner that a semi-circular hole F11 formed on a left side of the case F1 passes through a button 43 disposed on a left side of lower partition 4; a board-style retaining bolt F12 inserts downwards into latch grooves 43 formed on opposite sides of the semi-circular hole; a screw penetrates downwards through the upper partition 3 and then fixed in the screw hole 431 at an end of the button 43. As such, the case F1 can rotate outwards around the button 43. The case F1 comprises a pencil sharpener groove seat F14, an oblique press board F141 disposed in the groove seat F14 to enable the pencil sharpener F2 producing pressingly retaining function after inserting the pencil sharpener F2. The pencil sharpener groove seat F14 is provided with an LED lighting groove seat F16 on its rear for receiving accessories of an LED lighting F4, including an LED lighting F41, a positive pole spring F42, a switch spring F43 and a battery F44. A fixed cover F5 then locks and fixes the case upwards F1 to retain the pencil sharpener F2 and LED lighting F4, respectively, in the groove seats F14, F16. The fixed cover F5 is formed with a semi-circular groove F51 for loading and unloading the battery F44. The pencil sharpener groove seat F14 is formed with a square groove seat F15 for receiving spare staples. A bottom movable cover F3 is locked to the case F1 to cover the square groove seat F15 that receives spare staples and the battery F4. When one needs to use spare staples or change batteries, one only needs to open the movable cover F3 from the locked position of the case F1. The case F1 is formed with a switch groove seat F17 on its side into which a press-switch F45 may be pressed to operate a light porch.

The stapler C is constructed and locked into position by a top cover C1, a stapler body C2 and a seat C3. The stapler C is disposed between the upper partition 3 and the lower partition 4, like the pencil sharpener F. Long-hole style slideways 33, 44 are disposed symmetrically on a rear right side of the upper partition 3 and the lower partition 4. An axial pole C4 penetrates downwards through the slideway 44 of the lower partition, an axial hole C21 at an end of the stapler, an axial hole C11 at an end of the top cover, and the slideway 33 of the upper partition, and then fixed by a by screw cap, to allow outward pushing of the stapler from the sideway for use. When the stapler is not in use, it is pushed back. Retaining blocks 35, 46 on the upper right corner of the upper partition 3 and the lower partition 4 are locked into blocking grooves C12 formed on the front of the stapler top cover C1 to prevent stapler from emerging outwards.

The hole puncher D is disposed at a front of the stapler C and between the upper partition 3 and the lower partition 4. The hole puncher D comprises a hole puncher body D1, a grinding-proof sliding board D2 and a movable pressboard D3. The hole puncher body D1 is fixed to the upper partition 3 and the lower partition 4 by screws. The movable pressboard D3 includes protruding rotating axes D31 on opposite sides at an end thereof for embedding into axial holes 34, 45 formed on the upper partition 3 and the lower partition 4 to serve as a supporting point of the movable pressboard D3. The movable pressboard D3 serves as a lever for pressing the movable press board D3 downwards to cooperate with the grinding-proof sliding-board D2 and the hole puncher body D1 to thereby construct a hole puncher. A baffle D32 protrudes from the back of the movable pressboard D3 for preventing jamming by paper chips. The top cover 1 and the bottom seat 2 are formed with opening grooves 12, 23 at locations corresponding to the hole puncher, into which grooves paper may pinch.

Figures 5, 6:
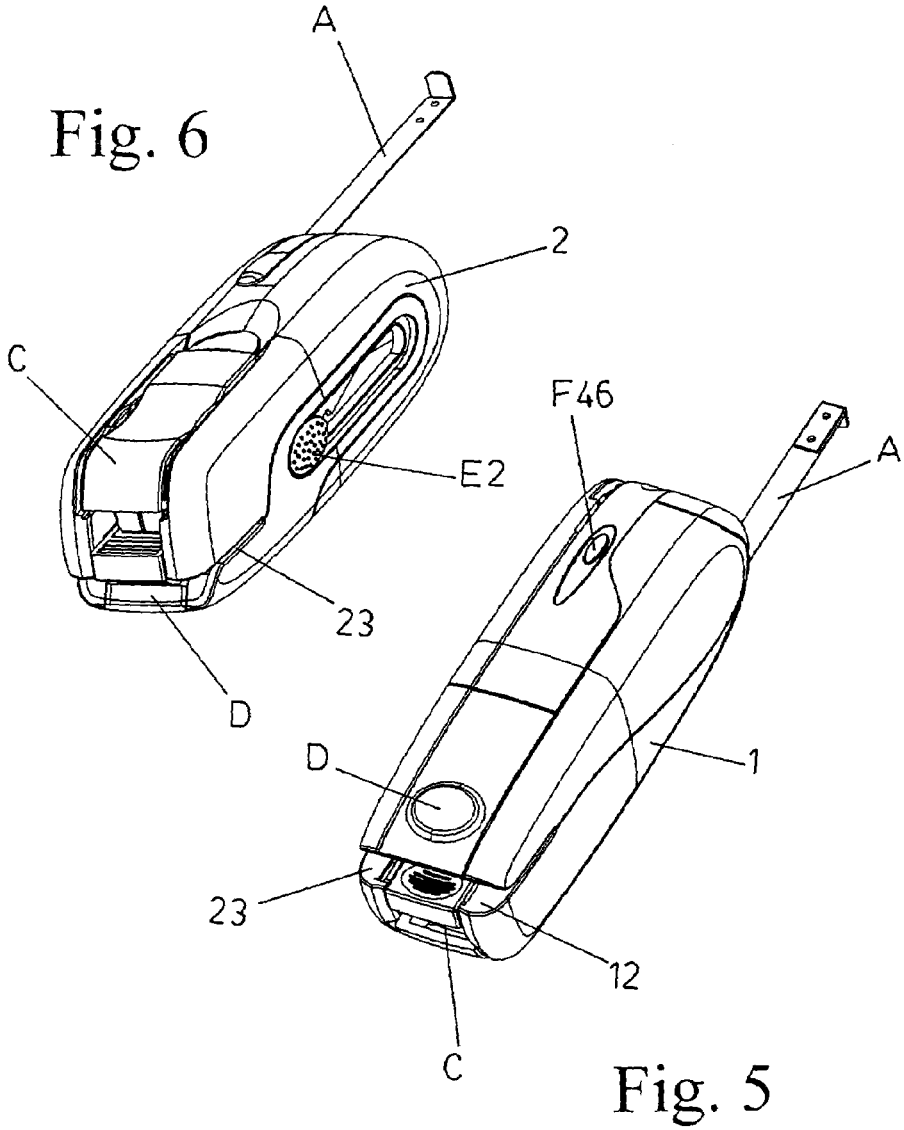
FIG. 5 is perspective outline of the present invention.
FIG. 6 is perspective outline of the present invention taken from another view.

Please refer to FIG. 4 and FIG. 5, which illustrate perspective outline of the present invention. The pocket stationery unit adopting precision designs and crafty room layout according the present invention, is equipped with ten functions in a single unit, including: a tape measure, a carton opener, a stapler, a hole puncher, scissors, a pencil sharpener, a nail file, an LED lighting, a minus-type and a Philips-type screw driver. The stationery unit can be easily carried and is especially suitable for students, office workers and frequent travelers.

What is claimed is:

1. A ten-in-one pocket stationery unit equipped with ten commonly used stationeries, including: a tape measure, a carton opener, a stapler, a hole puncher, scissors, a pencil sharpener, a nail file, an LED lighting, a minus-type and a Philips-type screw driver, in a housing defined by a top cover, a bottom seat, a upper partition and a lower partition, wherein:

the tape measure is received between a left side of the upper cover and the upper partition, a measuring tape and a retaining presser are fixed to the taper measure, which is fixed in a cupped area retained at a left side of the upper partition, so as to allow the measuring tape to be pulled in a lateral direction and controlled by the retaining presser to prevent from retraction;

the carton opener is retained at opposite sides of the tape measure and is fixed to an upper right corner of the upper partition by a rivet, the carton opener can rotate outwards around the rivet;

the nail file is fixed to an upper right corner of the lower partition by a rivet corresponding to the position of the carton opener, the nail file can rotate outwards around the rivet;

the scissors are retained on the same side as the tape measure, the scissors are fixed by an upper screw passing through an end fixing hole provided to the scissors and capped with a button protruding from a long hole groove provided to the bottom seat, so that the scissors are retained between an L-shaped groove of the lower partition and the long hole groove of the bottom seat, when pushing the button of the scissors outward from its sitting location to a critical point of a long side and a short side of the long hole groove and the L-shaped groove of the bottom seat, a U-shaped spring that is disposed on a bottom of the scissors and hooked to cupped grooves formed on opposite sides of the scissors will enable the initially closed scissors to open by means of the recovery force of the spring, thereby forcing the top cover to offset from the bottom seat by a small angle, wherein pressing the corresponding pressers of the top cover and the bottom seat, respectively allows operation of the scissors within the area of the short side of the L-shaped groove, a sliding rail is disposed between the U-shaped spring and the long hole groove of the bottom seat to prevent the U-shaped spring from touching the long groove of the bottom seat during movement due to point contact between the spring and the sliding rail to reduce friction produced by movement;

the pencil sharpener is disposed between the upper partition and the lower partition, the pencil sharpener includes a case that is fixed between the upper partition and the lower partition, in such a manner that a semi-circular hole formed on a left side of the case passes through a button disposed on a left side of lower partition; a board-style retaining bolt inserts downwards into latch grooves formed on opposite sides of the semi-circular hole; a screw penetrates downwards through the upper partition and then fixed in the screw hole at an end of the button, such that the case can rotate outwards around the button;

the stapler is constructed and locked into position by a top cover, a stapler body and a seat, the stapler is disposed between the upper partition and the lower partition, like the pencil sharpener, long-hole style slideways are disposed symmetrically on a rear right side of the upper partition and the lower partition, an axial pole penetrates downwards through the slideway of the lower partition, an axial hole at an end of the stapler, an axial hole at an end of the top cover, and the slideway of the upper partition, and then fixed by a by screw cap; and the hole puncher is disposed at a front of the stapler and between the upper partition and the lower partition, the hole puncher comprises a hole puncher body, a grinding-proof sliding board and a movable press board, the hole puncher body is fixed to the upper partition and the lower partition by screws, the movable press board includes protruding rotating axes on opposite sides at an end thereof for embedding into axial holes formed on the upper partition and the lower partition to serve as a supporting point of the movable press board, the movable press board serves as a lever for pressing the movable press board downwards to cooperate with the grinding-proof sliding-board and the hole puncher body to thereby construct a hole puncher, a baffle protrudes from the back of the movable press board for preventing jamming by paper chips.

2. A ten-in-one pocket stationery unit according to claim 1, wherein the carton opener includes a head that is formed with a flat to serve as a minus-type screw driver.

3. A ten-in-one pocket stationery unit according to claim 1, wherein the nail file includes a head that is formed with a tine taper to serve as a Philips-type screw driver.

4. A ten-in-one pocket stationery unit according to claim 1, wherein the pencil sharpener case comprises a pencil sharpener groove seat, an oblique press board disposed in the groove seat to enable the pencil sharpener producing pressingly retaining function after inserting the pencil sharpener, a fixed cover locks and fix the case upwards to retain the pencil sharpener.

5. A ten-in-one pocket stationery unit according to claim 4, wherein the pencil sharpener groove seat is formed with a square groove seat for receiving spare staples, a bottom movable cover is locked to the case.

6. A ten-in-one pocket stationery unit according to claim 4, wherein the pencil sharpener groove seat is provided with an LED lighting groove seat on its rear for receiving accessories of an LED lighting, including an LED lighting, a positive pole spring, a switch spring and a battery, a fixed cover locks and the movable cover fix the case upwards to retain the LED lighting.

7. A ten-in-one pocket stationery unit according to claim 4, wherein the case is formed with a switch groove seat on its side into which a press-switch may be pressed to operate a light porch.

8. A ten-in-one pocket stationery unit according to claim 4, wherein the top cover and the bottom seat are formed with opening grooves at locations corresponding to the hole puncher, into which grooves paper may pinch.

* * * * *